US010823402B2

(12) United States Patent
Cadima

(10) Patent No.: US 10,823,402 B2
(45) Date of Patent: Nov. 3, 2020

(54) GAS BURNER ASSEMBLY FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 225 days.

(21) Appl. No.: 15/672,351

(22) Filed: Aug. 9, 2017

(65) Prior Publication Data

US 2019/0049109 A1 Feb. 14, 2019

(51) Int. Cl.

| | |
|---|---|
| ***F23D 14/34*** | (2006.01) |
| ***F23D 14/70*** | (2006.01) |
| ***F23D 14/02*** | (2006.01) |
| ***F24C 3/08*** | (2006.01) |
| ***F23D 14/24*** | (2006.01) |

(52) U.S. Cl.

CPC ..... *F23D 14/24* (2013.01); *F23D 14/02* (2013.01); *F23D 14/34* (2013.01); *F23D 14/70* (2013.01); *F23D 2900/14062* (2013.01); *F24C 3/085* (2013.01)

(58) Field of Classification Search

CPC ..... F23D 14/02; F23D 14/34; F23D 14/70
USPC ..... 126/39 E, 39 R, 39 H, 39 J, 39 K, 39 N, 126/39 A; 431/351, 352
See application file for complete search history.

(56) References Cited

U.S. PATENT DOCUMENTS 2,184,653 A * 12/1939 Sherrick ..... F23D 14/00 431/198
3,645,249 A * 2/1972 Henderson ..... F24C 15/10 126/214 R (Continued)

FOREIGN PATENT DOCUMENTS

CA 2844828 A1 * 2/2013 ..... F23D 14/58
CN 2718400 Y * 8/2005 ..... F23D 14/34
CN 101825281 B 8/2012

(Continued)

OTHER PUBLICATIONS

"Machine Translation of CN2718400Y".*

(Continued)

*Primary Examiner* — Edelmira Bosques
*Assistant Examiner* — Christopher Matthew Odell
(74) *Attorney, Agent, or Firm* — Dority & Manning, P.A.

(57) ABSTRACT

A gas burner assembly for a cooktop appliance is provided including a bottom housing and a center body positioned concentrically within the bottom housing. A mixing chamber is defined between the bottom housing and the center body, and the center body further defines an inner chamber positioned radially inward of the mixing chamber. Apertures provide fluid communication between the mixing chamber and the inner chamber. An upper housing is positioned over the center body and defines a primary burner chamber and a boost burner chamber, the boost burner chamber being in fluid communication with the inner chamber of the center body. A primary fuel inlet is in fluid communication with the primary burner chamber and a boost fuel inlet and a boost air inlet are in fluid communication with the mixing chamber.

20 Claims, 8 Drawing Sheets

(56) References Cited

U.S. PATENT DOCUMENTS

| | | | | | |
|---|---|---|---|---|---|
| 4,055,152 | A * | 10/1977 | Vidalenq | F23D 14/02 | 122/235.11 |
| 4,311,451 | A | 1/1982 | Matumoto et al. | | |
| 5,325,842 | A * | 7/1994 | Beach | F24C 3/126 | 126/21 R |
| 5,957,683 | A * | 9/1999 | Yokoyama | F23D 14/06 | 126/39 R |
| 6,322,354 | B1 | 11/2001 | Carbone et al. | | |
| 7,425,127 | B2 * | 9/2008 | Zinn | F23C 5/24 | 431/115 |
| 9,879,855 | B2 * | 1/2018 | Rivera Garza | F23D 14/58 | |
| 2007/0145032 | A1 * | 6/2007 | Graham | F23D 14/105 | 219/392 |
| 2015/0107577 | A1 * | 4/2015 | Jeong | F24C 3/08 | 126/39 E |
| 2015/0159880 | A1 * | 6/2015 | Gen | F24C 3/08 | 126/39 E |

FOREIGN PATENT DOCUMENTS

| | | | | | |
|---|---|---|---|---|---|
| CN | 10244892 | B | 1/2016 | | |
| EP | 2072900 | A1 * | 6/2009 | F23D 14/02 | |
| JP | 56155308 | A * | 12/1981 | | |
| JP | 01234717 | A * | 9/1989 | | |
| WO | WO-2017152826 | A1 * | 9/2017 | F23D 14/70 | |

OTHER PUBLICATIONS

"Abstract of JPS56155308". 1981.*
"Machine Translation of JPS56155308". 2019.*
"Machine Translation for JPH01234717." 2020.*
"Machine Translation of WO2017152826". 2020.*

* cited by examiner

GAS BURNER ASSEMBLY FOR A COOKTOP APPLIANCE

FIELD OF THE INVENTION

The present subject matter relates generally to cooktop appliances and more particularly to gas burner assemblies for cooktop appliances.

BACKGROUND OF THE INVENTION

Gas burners are commonly used on the cooktops of household gas cooking appliances including e.g., range ovens and cooktops built into cabinetry. For example, gas cooktops traditionally have at least one gas burner positioned at a cooktop surface for use in heating or cooking an object, such as a cooking utensil and its contents. Control knobs are typically used to adjust the power level of the heating element, i.e., the amount of fuel directed to the burner, and thus the amount of heat delivered by the gas burner.

Normally aspirated gas burners rely on the energy available in the form of pressure from the fuel supplied to the gas burner to entrain air for combustion. Because the nominal pressure in households is relatively low, there is a practical limit to the amount of primary air a normally aspirated gas burner can entrain. Introducing a fan or another forced air supply into a gas burner assembly may improve the mixture of fuel and air for improved operation at higher outputs, with shorter flames and improved stability, and with improved efficiency.

However, the noise generated when a fuel mixture is discharged from a forced air gas burner is often loud due to the high speed of discharge. For example, fully premixed fuel burns at relatively high speeds and thus the flow of gas exiting the ports must be high enough to keep the flames from burning back into the burner and to generate a stable flame. These high speeds are favorable for creating turbulences which contribute to undesirable operating noises.

Another problem is how to fully mix the fuel and air to create a more homogenous solution at the burner flame ports, resulting in uniform and stable flames. More specifically, lack of good mixing causes the flames to waver and vary, which is both undesirable and contributes to combustion noise. Complete mixing is facilitated by introducing turbulence into the air and fuel mixing paths, and long residence times of the air and fuel. However, turbulence contributes to noise and using large mixing chambers to help increase residence times is often not feasible when designing gas burners to fit within tight compartments typical of household appliances.

Accordingly, a cooktop appliance having an improved gas burner assembly is desirable. More particularly, a gas burner assembly including a forced air burner for cooking that can operate at high rates and near or at fully premixed conditions, yet do so quietly and within a compact arrangement suitable for a household appliance would be particularly beneficial.

BRIEF DESCRIPTION OF THE INVENTION

The present disclosure relates generally to a gas burner assembly for a cooktop appliance including a bottom housing and a center body positioned concentrically within the bottom housing. A mixing chamber is defined between the bottom housing and the center body, and the center body further defines an inner chamber positioned radially inward of the mixing chamber. Apertures provide fluid communication between the mixing chamber and the inner chamber. An upper housing is positioned over the center body and defines a primary burner chamber and a boost burner chamber, the boost burner chamber being in fluid communication with the inner chamber of the center body. A primary fuel inlet is in fluid communication with the primary burner chamber and a boost fuel inlet and a boost air inlet are in fluid communication with the mixing chamber. Additional aspects and advantages of the invention will be set forth in part in the following description, or may be apparent from the description, or may be learned through practice of the invention.

In one exemplary embodiment, a gas burner assembly for a cooktop appliance is provided. The gas burner assembly includes a bottom housing defining an axial direction, a radial direction, and a circumferential direction. A center body is positioned concentrically within the bottom housing to define a mixing chamber therebetween, the center body further defining an inner chamber positioned inward of the mixing chamber along the radial direction and a plurality of apertures providing fluid communication between the mixing chamber and the inner chamber. An upper housing is positioned over the center body and defines a primary burner chamber and a boost burner chamber, the boost burner chamber being in fluid communication with the inner chamber of the center body. A primary fuel inlet is in fluid communication with the primary burner chamber and a boost fuel inlet and a boost air inlet are in fluid communication with the mixing chamber.

In another exemplary embodiment, a cooktop appliance is provided. The cooktop appliance includes a top panel and a gas burner assembly positioned on the top panel. The gas burner assembly includes a bottom housing defining an axial direction, a radial direction, and a circumferential direction. A center body is positioned concentrically within the bottom housing to define a mixing chamber therebetween, the center body further defining an inner chamber positioned inward of the mixing chamber along the radial direction and a plurality of apertures providing fluid communication between the mixing chamber and the inner chamber. An upper housing is positioned over the center body and defines a primary burner chamber and a boost burner chamber, the boost burner chamber being in fluid communication with the inner chamber of the center body. A primary fuel inlet is in fluid communication with the primary burner chamber and a boost fuel inlet and a boost air inlet are in fluid communication with the mixing chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a top view of a cooktop appliance according to an exemplary embodiment of the present subject matter.

Figure 7:
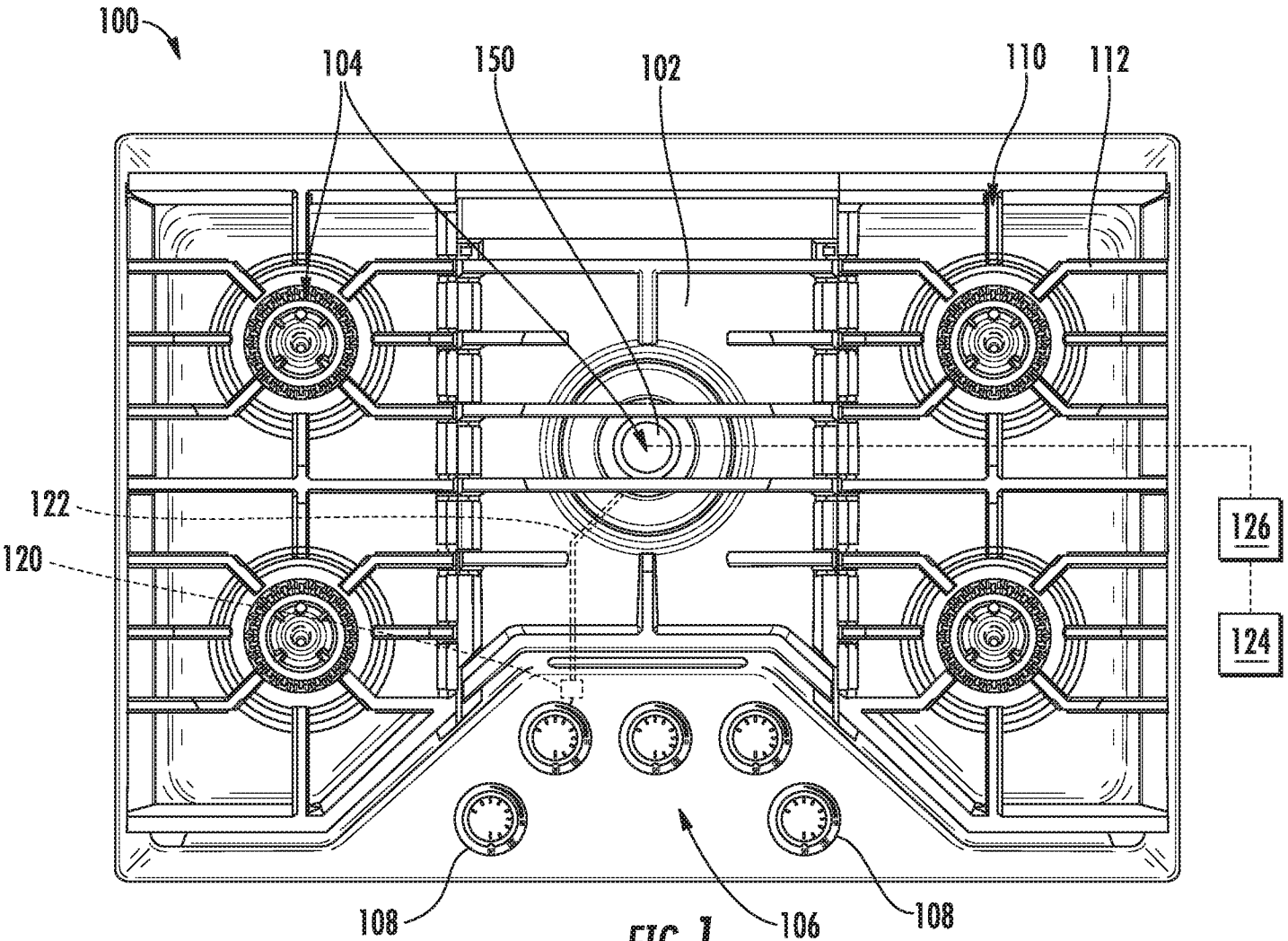
FIG. 7 provides a bottom perspective view of a center body of the exemplary gas burner assembly of FIG. 2.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, e.g., electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

According to the illustrated embodiment, cooktop appliance 100 is a gas cooktop and heating elements 104 are gas burners, such as gas burner assembly 150 described below. As illustrated, heating elements 104 are positioned within top panel 102 and have various sizes, as shown in FIG. 1, so as to provide for the receipt of cooking utensils (e.g., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
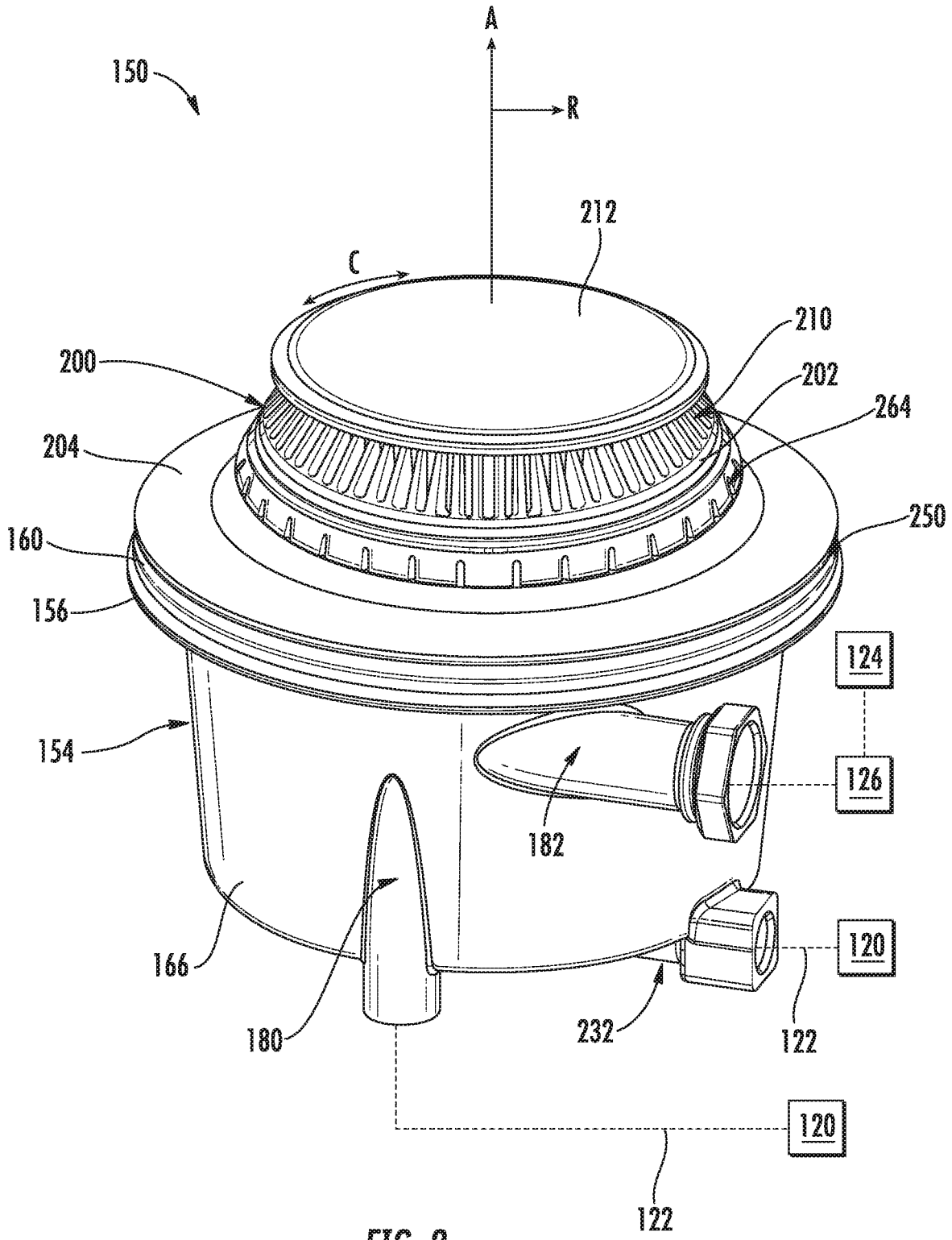
FIG. 2 provides a perspective view of a gas burner assembly of the exemplary cooktop appliance of FIG. 1 according to an exemplary embodiment of the present subject matter.
Figure 3:
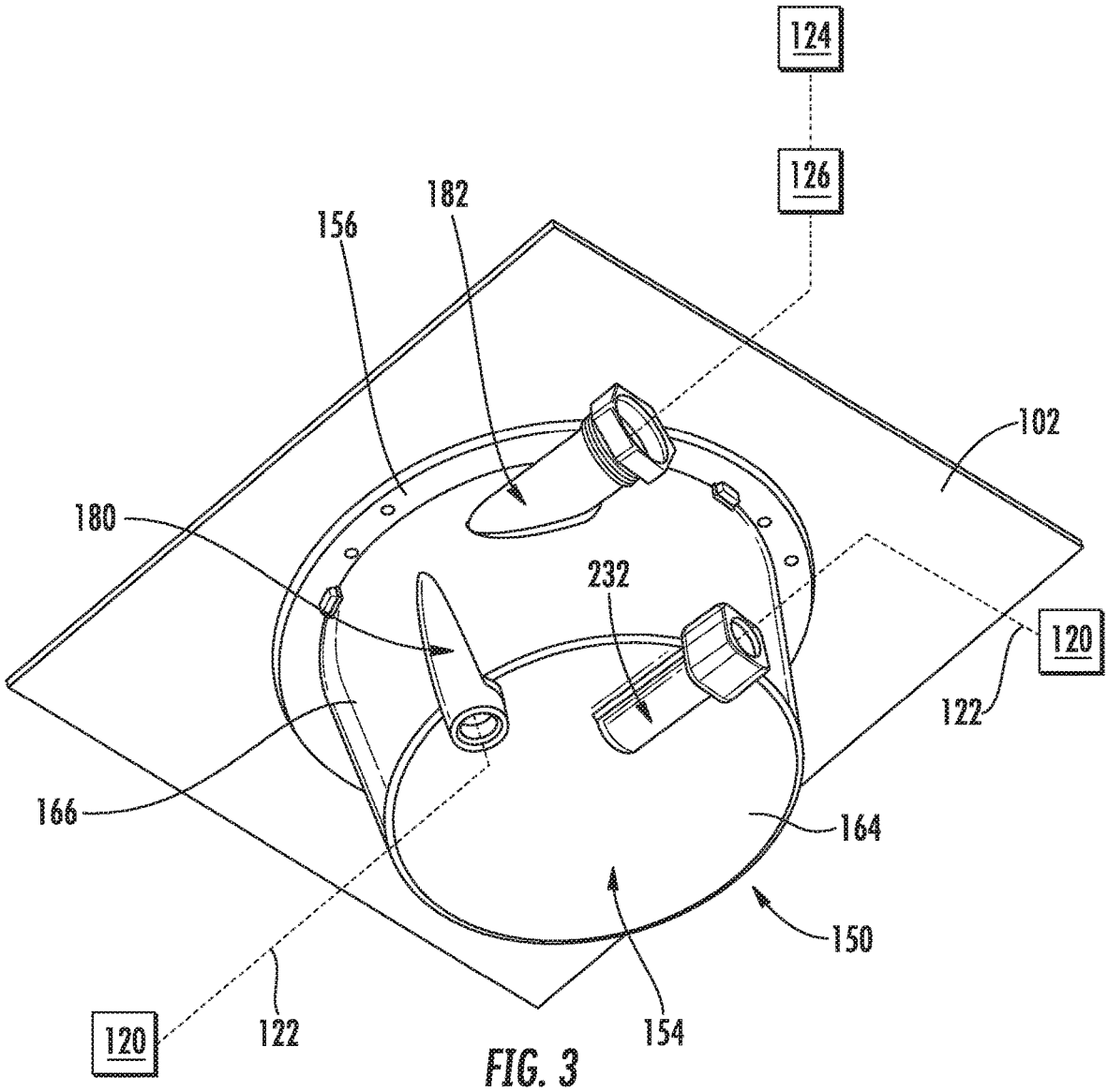
FIG. 3 provides a bottom perspective view of the exemplary gas burner assembly of FIG. 2 positioned within a top panel of the exemplary cooktop appliance of FIG. 1.

As shown schematically in FIGS. 1 through 3, cooktop appliance 100 includes a variety of control elements for regulating the amount of heat generated by heating elements 104. For example, as explained below, heating element 104 is a gas burner assembly 150 that uses one or more flows of fuel and one or more flows of air for combustion. Thus, cooktop appliance 100 includes fuel control valves 120 and fuel lines 122 for supplying a metered amount of fuel to heating element 104. Fuel lines 122 extend between control valves 120 and one or more fuel orifices of heating element 104. Thus, when control valves 120 are open, fuel such as propane or natural gas may flow through fuel lines 122 to the fuel orifices for combustion. Similarly, cooktop appliance 100 includes a forced air supply 124 and an air regulator 126 for controlling the amount of forced air introduced to heating element 104 for combustion. For example, forced air supply 124 may be a fan, an air compressor, or any other suitable source of air.

Cooktop appliance 100 may further include features for assisting mixing of air and fuel as the fuel enters heating element 104, e.g., injectors, Venturi mixers, etc. According to an exemplary embodiment, fuel control valves 120 are each coupled to a respective one of control knobs 108. Thus, a user may adjust fuel control valves 120 with control knobs 108, thereby regulating fuel flow to heating elements 104. Similarly, air regulator 126 may be either directly controlled by control knob 108 or may be controlled based on the amount of fuel supplied to obtain the desired air/fuel ratio for combustion. According to an exemplary embodiment, some or all of these control components may be mounted to top panel 102, e.g., on a bottom surface or underside of top panel 102.

Referring now generally to FIGS. 2 through 10, a gas burner assembly 150 that may be used with cooktop appliance 100 will be described in more detail. Although the discussion below refers to an exemplary gas burner assembly 150, it should be appreciated that the features and configurations described may be used for other heating elements in other cooking appliances or consumer appliances as well. For example, gas burner assembly 150 may be positioned elsewhere within cooktop appliance 100, may have different components or configurations, and may use alternative mechanisms for mixing fuel and air for combustion. Other variations and modifications of the exemplary embodiment described below are possible, and such variations are contemplated as within the scope of the present subject matter.

Figure 4:
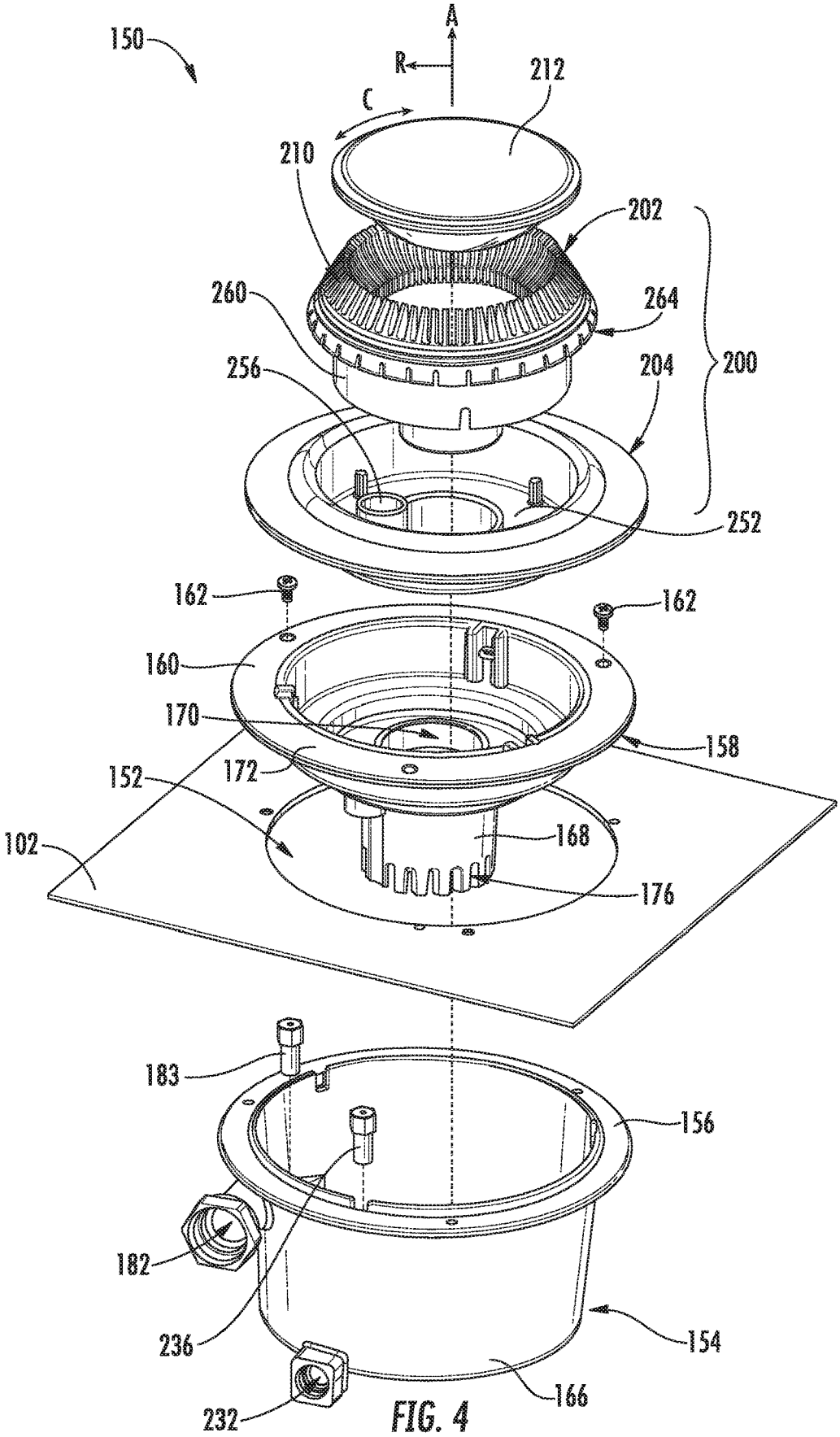
FIG. 4 provides an exploded perspective view of the exemplary gas burner assembly of FIG. 2.

Referring now to FIG. 4, an exploded view of gas burner assembly 150 will be described. As shown, gas burner assembly 150 generally defines an axial direction A, a radial direction R, and a circumferential direction C. As illustrated, gas burner assembly 150 is mounted within an aperture 152 defined in top panel 102 of cooktop appliance 100. More specifically, gas burner assembly 150 includes a bottom housing 154 that defines a bottom flange 156 and is generally positioned below top panel 102 and a center body 158 that defines a top flange 160 and is generally positioned above top panel 102. According to the illustrated embodiment, gas burner assembly 150 is installed in aperture 152 by joining bottom housing 154 and center body 158 using any suitable mechanical fastener 162, such as screws, bolts, rivets, etc. Similarly, glue, bonding, snap-fit mechanisms, interference-fit mechanisms, or any suitable combination thereof may be used to join bottom housing 154 and center body 158.

Figure 5:
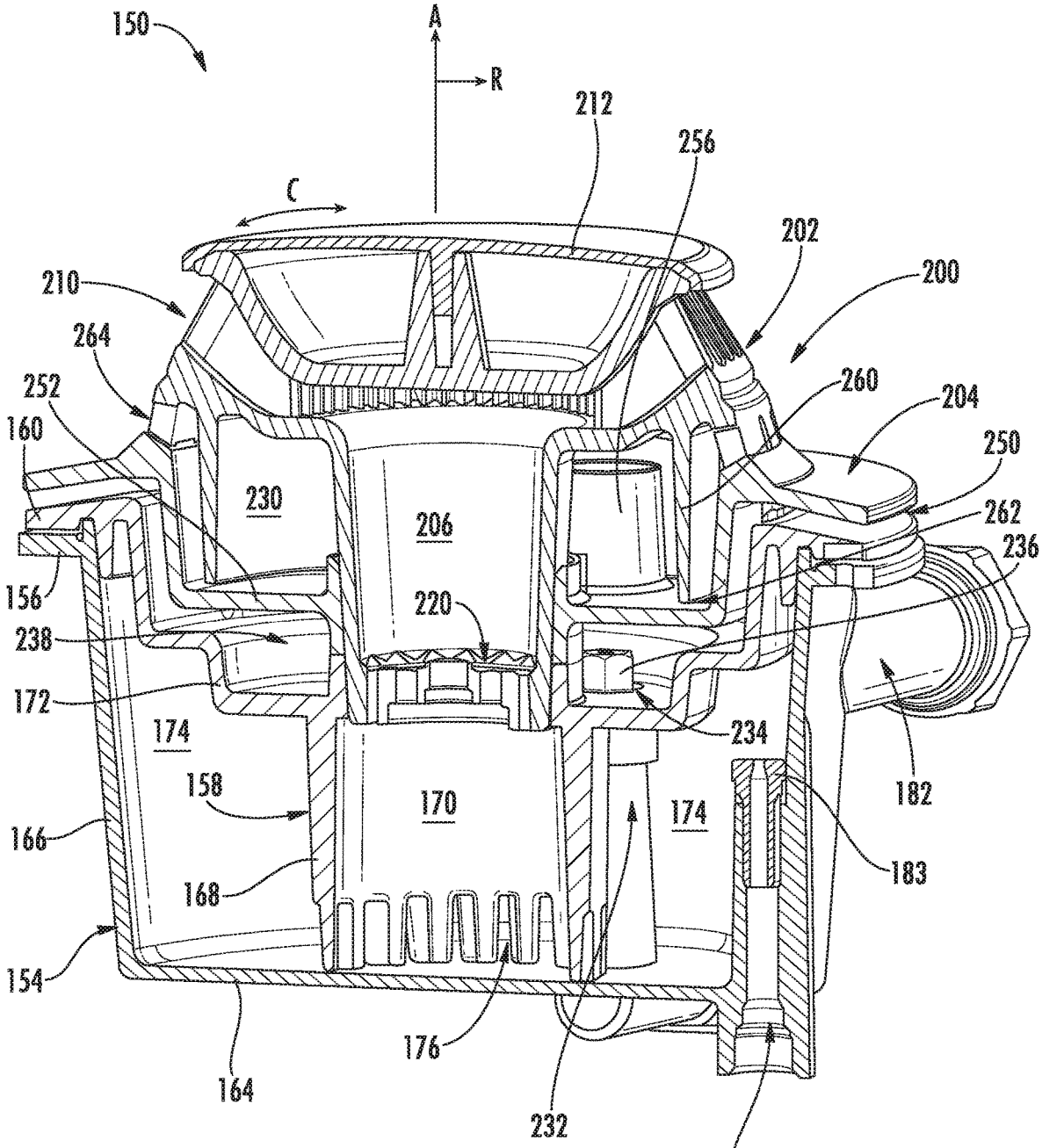
FIG. 5 provides a cross sectional view of the exemplary gas burner assembly of FIG. 2.

Referring now also to FIG. 5, bottom housing 154 includes a bottom wall 164 and a side wall 166 which is generally cylindrically shaped and defines an open top. In addition, center body 158 generally includes a cylindrical lower wall 168 that defines an inner chamber 170 and an upper wall 172 that extends along the radial direction R out to top flange 160. Center body 158 is mounted within bottom housing 154 such that it is positioned concentrically within bottom housing 154 to define an annular mixing chamber 174, e.g., positioned between lower wall 168 and cylindrical wall 166. In this manner, inner chamber 170 is positioned inward of mixing chamber 174 along the radial direction R to define two separate chambers. In addition, according to an exemplary embodiment, lower wall 168 of center body 158 defines a plurality of apertures 176 providing fluid communication between mixing chamber 174 and inner chamber 170.

Mixing chamber 174 and inner chamber 170 are generally configured for receiving a flow of air and a flow of fuel and fully premixing them into a homogenous fuel mixture prior to combustion. In this manner, for example, bottom housing 154 defines a boost fuel inlet 180 and a boost air inlet 182 that are each in fluid communication with mixing chamber 174. Boost fuel inlet 180 and boost air inlet 182 provide a flow of fuel and forced air, respectively, into mixing chamber 174. In order to increase residence time of the air and fuel to improve mixing, according to the illustrated embodiment, boost fuel inlet 180 and boost air inlet 182 are positioned proximate a top of mixing chamber 174, e.g., adjacent upper wall 172, and the plurality of apertures 176 are defined proximate a bottom of mixing chamber 174, e.g., as slots or openings defined by a distal end of lower wall 168. In this manner, fuel and air injected into mixing chamber 174 travel circumferentially within mixing chamber 174 around lower wall 168 as they migrate towards bottom wall 164 where they enter inner chamber 170 through apertures 176.

Figure 6:
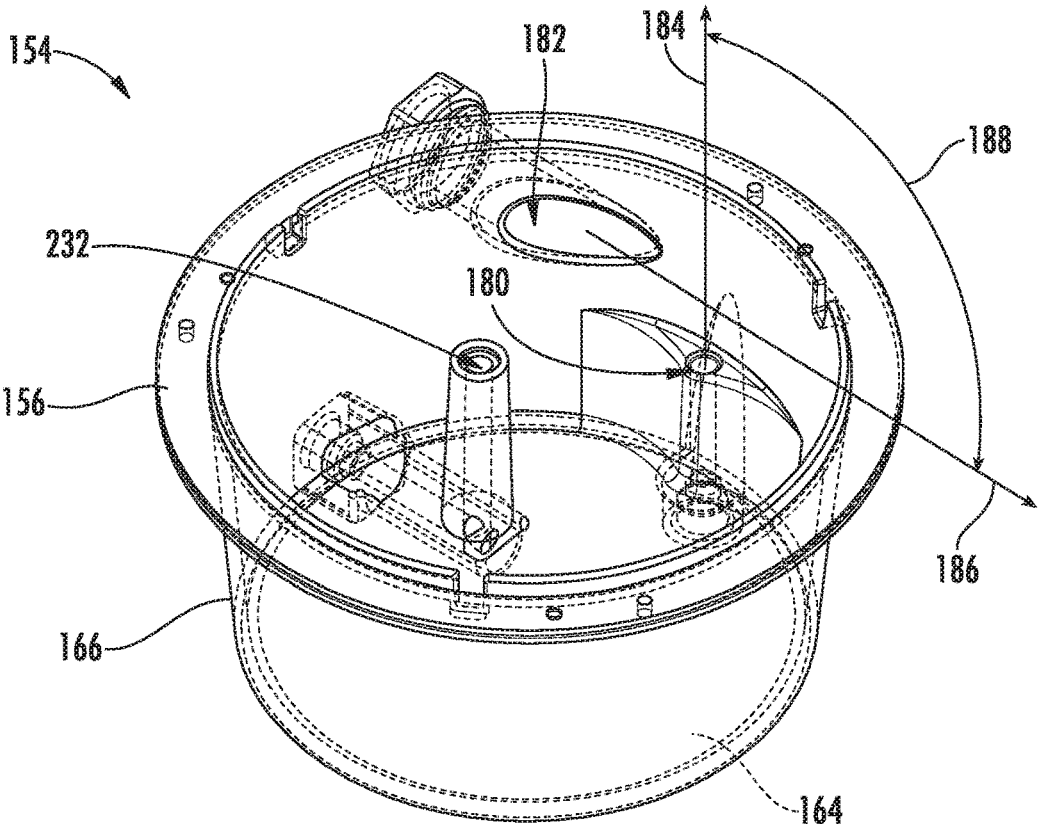
FIG. 6 provides a top perspective view of a bottom housing of the exemplary gas burner assembly of FIG. 2 with fuel and air inlets illustrated in phantom.
Figure 7:
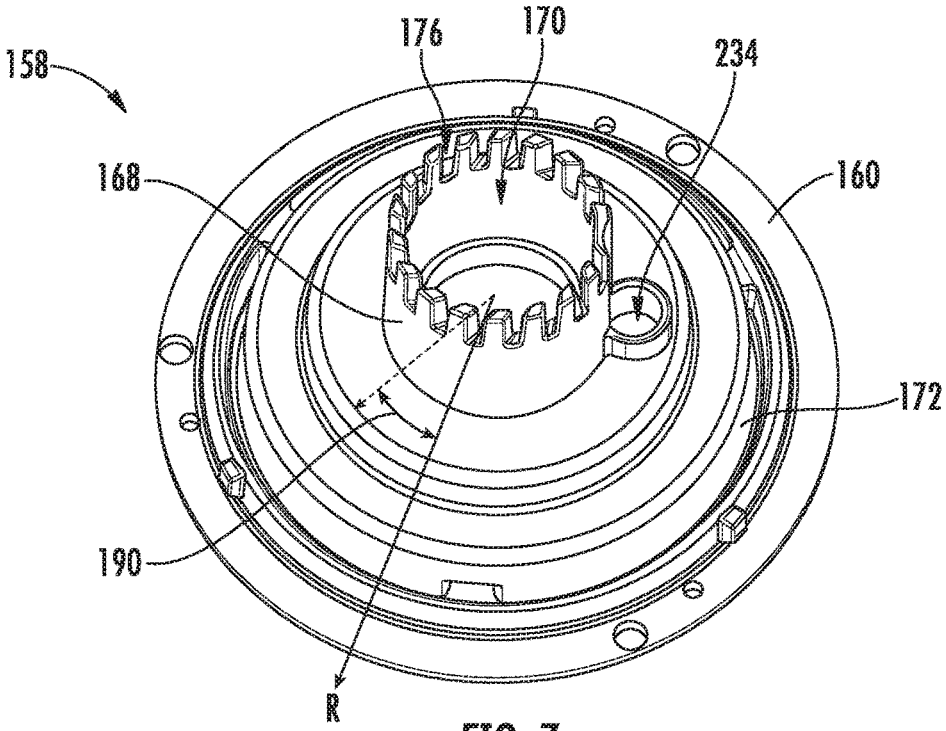
Figure 8:
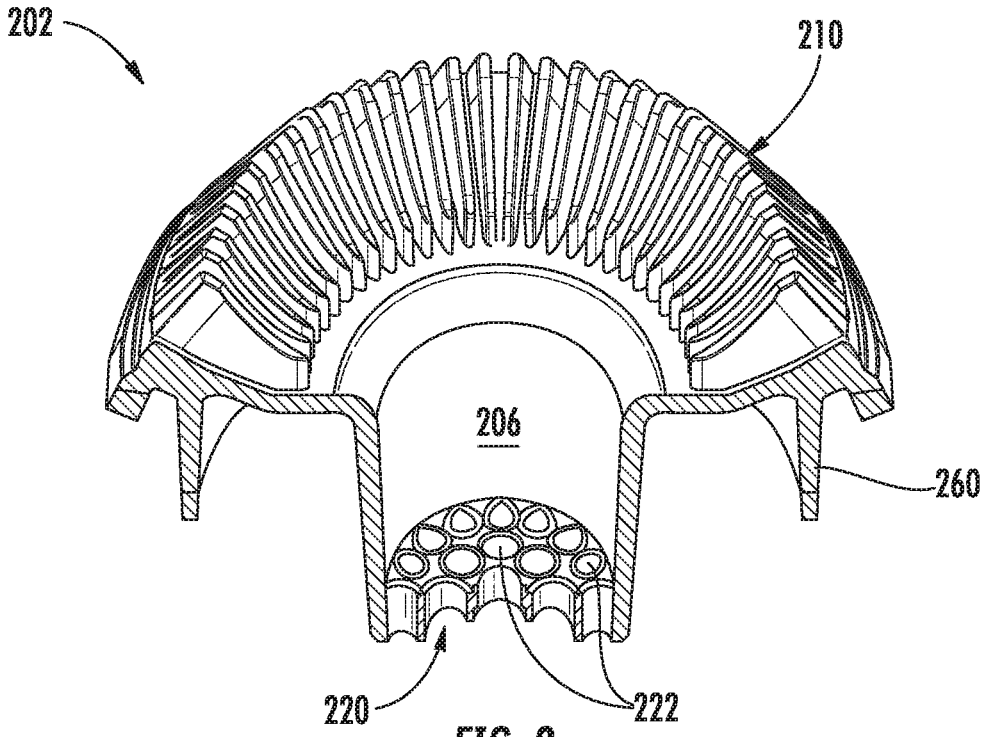
FIG. 8 provides a cross sectional view of the exemplary center body of FIG. 7.
Figure 9:
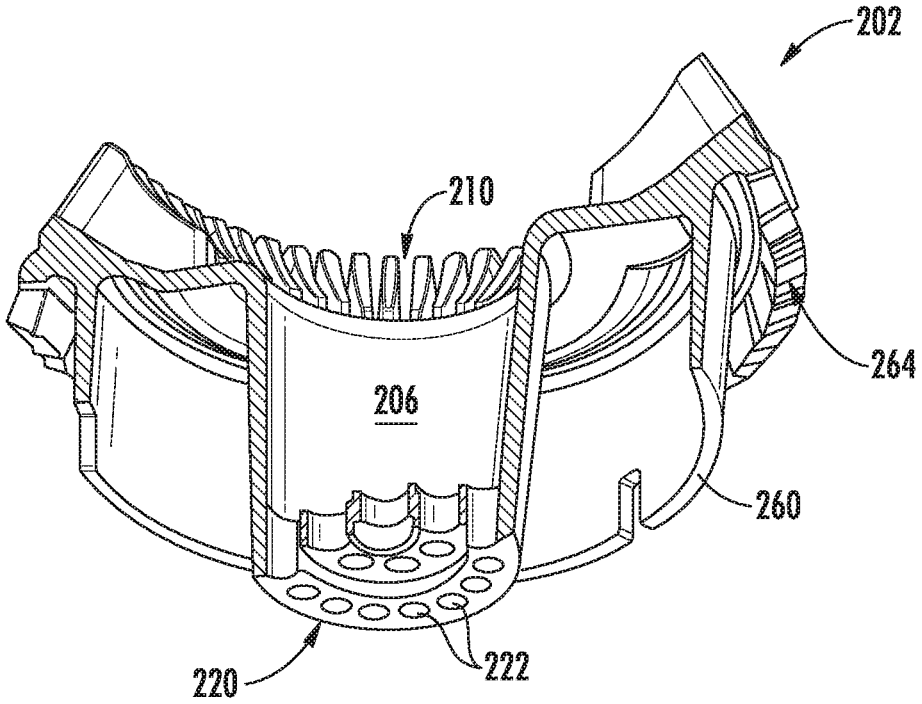
FIG. 9 provides another cross sectional view of the exemplary center body of FIG. 7.
Figure 10:
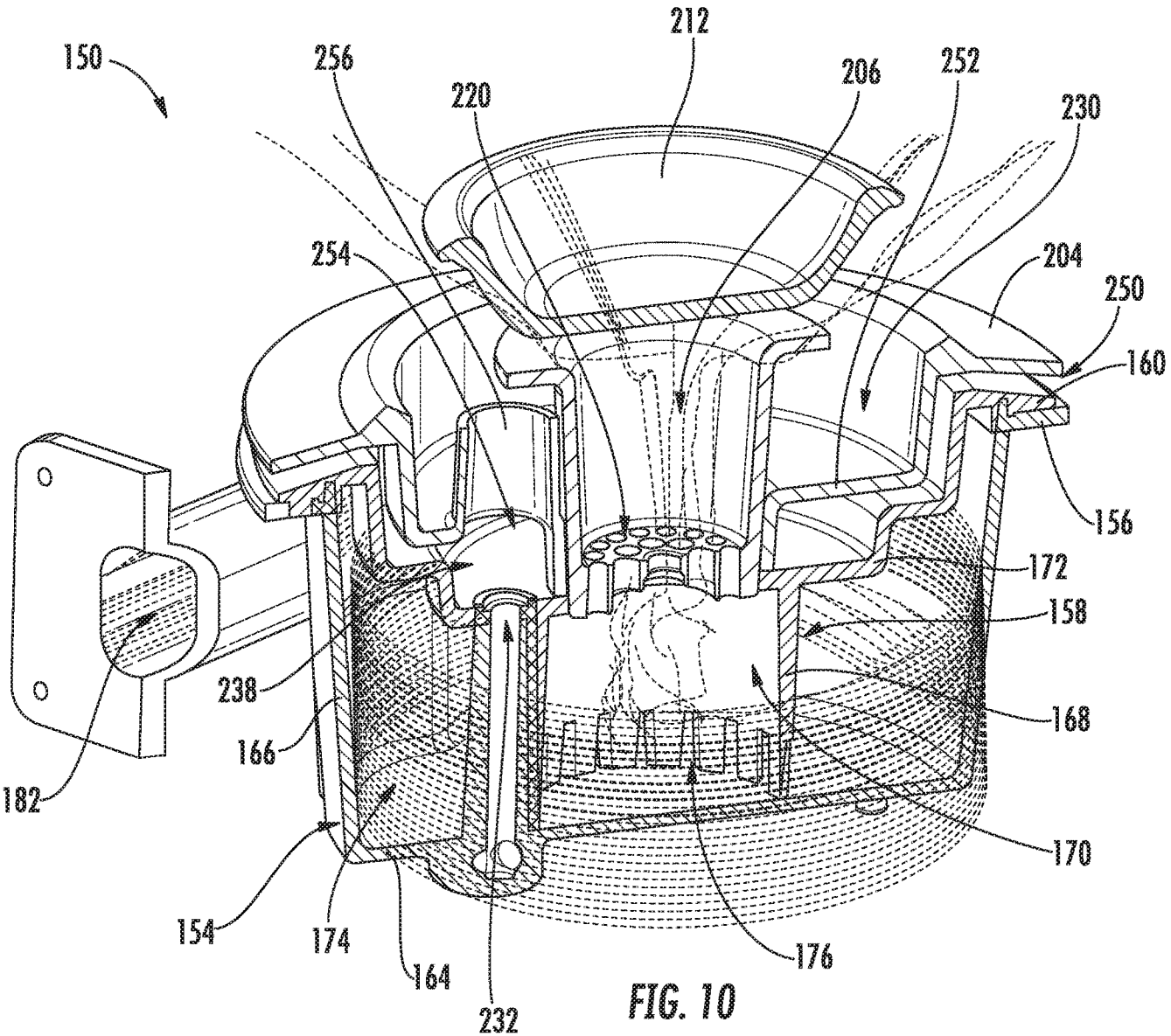
FIG. 10 provides a cross sectional view of the exemplary gas burner assembly of FIG. 2 with an exemplary flow path of fuel and air illustrated by dotted lines and portions of gas burner assembly removed for clarity.

As best illustrated in FIG. 6, bottom housing 154 includes a variety of features to facilitate proper mixing of fuel and air for combustion. For example, boost fuel inlet 180 may terminate in a spray nozzle 183 (see FIGS. 4 and 5) for directing the flow of fuel as desired. In addition, as illustrated, boost fuel inlet 180 injects a flow of fuel along a first direction 184 and boost air inlet 182 injects a flow of air along a second direction 186. In order to generate turbulence between the two flows, second direction 186 is substantially perpendicular to first direction 184. More specifically, first direction 184 and second direction 186 define an intersection angle 188 of approximately 90 degrees. It should be appreciated that intersection angle 188 may vary according to alternative embodiments.

In addition, first direction 184 is substantially parallel to the axial direction A such that fuel is injected upward and second direction 186 extends tangentially from cylindrical wall 166 such that boost air inlet 182 discharges air tangentially. Moreover, boost fuel inlet 180 and boost air inlet 182 are illustrated as being positioned proximate to each other on bottom housing 154 such that the flow of air and fuel have high velocity when they begin mixing. The interaction between the two flows results in a desirable swirling motion within mixing chamber 174 (see FIG. 10) and results in high turbulence and extended residence time.

As best illustrated in FIGS. 6 and 7, center body 158 also includes features to facilitate proper mixing of fuel and air for combustion. For example, as illustrated, apertures 176 extend through center body 158 at an angle 190 relative to the radial direction R. Angle 190 may be selected to reduce drag on the flow of fuel and air and/or to continue swirling the flows for improved mixing.

Referring again to FIGS. 4 and 5, cooktop appliance 100 further includes an upper housing assembly or upper housing 200 positioned over center body 158 along the axial direction A. Upper housing 200 may include one or more components for receiving and conditioning one or more flows of fuel and air and passing it/them to various flame ports defined by upper housing 200. As shown in the figures, upper housing 200 actually includes a top portion 202 and a bottom portion 204 that are joined together to define a primary burner and a boost burner, but these components will be referred to generally herein as upper housing 200.

Upper housing 200 generally defines a boost burner chamber 206 that extends along the axial direction A and is in fluid communication with inner chamber 170 of center body 158. As shown also in FIGS. 8 and 9, top portion 202 defines a plurality of boost flame ports 210 spaced about the circumferential direction C and in fluid communication with boost burner chamber 206. In addition, a top cap 212 is positioned on top of top portion 202 to provide a clean appearance to gas burner assembly 150 and to help disperse the fuel mixture around boost flame ports 210.

Gas burner assembly 150 further includes a flow developer 220 for straightening the flow of fuel mixture prior to passing through boost flame ports 210. For example, as illustrated, top portion 202 defines flow developer 220 which is positioned between inner chamber 170 and boost burner chamber 206 for straightening or conditioning a flow of mixed fuel and air. It should be appreciated that although flow developer 220 is illustrated as being positioned at a bottom of upper housing 200, flow developer 220 could be defined by center body 158 or could be a separate component according to alternative embodiments. In general, flow developer 220 includes a plurality of conduits or passageways 222 that extend generally along the axial direction A between inner chamber 170 and boost burner chamber 206. According to alternative embodiments, flow developer 220 may include a plurality of fins extending along the axial direction A or any other flow straightening structure.

In addition to including a boost burner as described above, gas burner assembly 150 further includes a primary burner. According to an exemplary embodiment, the primary burner is a normally aspirated burner that may be regulated for normal operation while iLhboost burner is a discretely operating (i.e., on or off) auxiliary forced air burner intended for performing high heat operations such as boiling a large pot of water. However, it should be appreciated that the primary burner and boost burner may both be incrementally regulated simultaneously or independently of each other according to alternative embodiments.

As shown, upper housing 200 defines a primary burner chamber 230, or more specifically, primary burner chamber 230 is defined between top portion 202 and bottom portion 204. A primary fuel inlet 232 is in fluid communication with primary burner chamber 230 for providing a flow of fuel into primary burner chamber 230. More specifically, as illustrated in FIGS. 4 through 7, primary fuel inlet 232 passes from bottom wall 164 of bottom housing 154 along the axial direction A through mixing chamber 174. Primary fuel inlet 232 then passes through an aperture 234 (FIG. 7) defined in upper wall 172 of center body 158 and terminates in a spray nozzle 236 within an air entrainment chamber 238 defined between upper wall 172 and bottom portion 204 of upper housing 200.

Air entrainment chamber 238 is in fluid communication with a primary air inlet 250 that extends about the circumferential direction C above top panel 102 of cooktop appliance 100. More specifically, primary air inlet 250 is defined between upper wall 172 of center body 158 and bottom portion 204 of upper housing 200. In this manner, fresh primary supply air may be drawn from ambient air through primary air inlet 250 into air entrainment chamber 238. In addition, as best shown in FIG. 5, air entrainment chamber 238 is separated from primary burner chamber 230 by a divider wall 252 that extends along the radial direction R and is part of bottom portion 204. Divider wall 252 defines an aperture 254 (see FIG. 10) through which fuel discharged from spray nozzle 236 passes through air entrainment chamber 238 and into primary burner chamber 230. In this manner, ambient air from within air entrainment chamber 238 is entrained and mixed with the supply of fuel from primary fuel inlet 232 as it is injected into primary burner chamber 230.

In addition, a cylindrical channel 256 extends around aperture 254 and toward top portion 202 of upper housing 200. Notably, cylindrical channel 256 terminates proximate a top of primary burner chamber 230, e.g., adjacent top portion 202 of upper housing 200. In this manner, cylindrical channel 256 discharges a mixture of fuel and air proximate a top of primary burner chamber 230. In addition, top portion 202 of upper housing 200 defines a circumferential baffle 260 that is positioned within primary burner chamber 230 and extends down along the axial direction A toward bottom portion 204 to define an annular opening 262 proximate a bottom of primary burner chamber 230. In this manner, the fuel and air mixture that is ejected into primary burner chamber 230 migrates from a top of primary burner chamber 230 downward along the axial direction A toward annular opening 262, thereby increasing residence time and ensuring the mixture is more evenly dispersed throughout primary burner chamber 230 for improved combustion.

Upper housing 200 also defines a plurality of primary flame ports 264 spaced about the circumferential direction C and in fluid communication with primary burner chamber 230 via annular opening 262. More specifically, primary flame ports 264 are defined between top portion 202 and bottom portion 204 of upper housing 200. In this manner, primary flame ports 264 are positioned below boost flame ports 210 along the axial direction A.

One skilled in the art will appreciate that in addition to the configurations of gas burner assembly 150 described herein, alternative configurations of gas burner assembly 150 are possible and within the scope of the present subject matter. For example, the size, positioning, and configuration of bottom housing 154, center body 158, and upper housing 200 may vary, the various fuel and air mixing chambers may be positioned differently, and other mixing features or configurations may be used. It should be appreciated that still other configurations are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A gas burner assembly for a cooktop appliance, the gas burner assembly comprising:

a bottom housing defining an axial direction, a radial direction, and a circumferential direction;

a center body positioned concentrically within the bottom housing to divide the bottom housing into a mixing chamber extending between the bottom housing and the center body along the radial direction and, an inner mixing chamber positioned inward of the center body and the mixing chamber along the radial direction, the center body further defining a plurality of apertures providing fluid communication between the mixing chamber and the inner mixing chamber;

an upper housing positioned over the center body and defining a boost burner chamber and a primary burner chamber, the boost burner chamber being in fluid communication with the inner mixing chamber of the center body;

a primary fuel inlet in fluid communication with the primary burner chamber; and a boost fuel inlet and a boost air inlet directly coupled to the bottom housing and being in fluid communication with the mixing chamber, such that a flow of fuel and a flow of air mix in the mixing chamber before passing into the inner mixing chamber through the plurality of apertures.

2. The gas burner assembly of claim 1, further comprising:

a forced air supply source fluidly coupled to the boost air inlet, wherein the boost air inlet is defined by the bottom housing.

3. The gas burner assembly of claim 1, wherein the boost fuel inlet injects the flow of fuel along a first direction and the boost air inlet injects the flow of air along a second direction, the second direction being perpendicular to the first direction.

4. The gas burner assembly of claim 3, wherein the bottom housing defines a cylindrical side wall and the second direction extends tangential the cylindrical side wall.

5. The gas burner assembly of claim 1, wherein the boost fuel inlet and the boost air inlet are positioned adjacent to each other on the bottom housing.

6. The gas burner assembly of claim 1, wherein the boost fuel inlet and the boost air inlet are positioned proximate a top of the mixing chamber and the plurality of apertures are defined proximate a bottom of the mixing chamber.

7. The gas burner assembly of claim 1, wherein the plurality of apertures extends through the center body at an angle relative to the radial direction.

8. The gas burner assembly of claim 1, wherein the upper housing defines:

a plurality of boost flame ports spaced about the circumferential direction and in fluid communication with the boost burner chamber; and a plurality of primary flame ports spaced about the circumferential direction and in fluid communication with the primary burner chamber, the plurality of primary flame ports being positioned below the plurality of boost flame ports along the axial direction.

9. The gas burner assembly of claim 1, wherein the upper housing defines a primary air inlet extending about the circumferential direction above a top panel of the cooktop appliance, the primary air inlet being in fluid communication with an air entrainment chamber that is separated from the primary burner chamber by a divider wall, and wherein the primary fuel inlet sprays fuel through a hole defined in the divider wall such that ambient air is entrained with the fuel and ejected into the primary burner chamber.

10. The gas burner assembly of claim 9, wherein the air entrainment chamber is positioned below the primary burner chamber and the primary fuel inlet discharges the flow of fuel which passes proximate a top of the primary burner chamber.

11. The gas burner assembly of claim 1, further comprising a circumferential baffle positioned within the primary burner chamber and defining an annular opening proximate a bottom of the primary burner chamber.

12. The gas burner assembly of claim 1, further comprising a flow developer positioned between the inner mixing chamber and the boost burner chamber for straightening or conditioning a flow of mixed fuel and air.

13. The gas burner assembly of claim 12, wherein the flow developer comprises a plurality of passageways or a plurality of fins extending along the axial direction.

14. The gas burner assembly of claim 12, wherein the flow developer is defined at a bottom of the upper housing.

15. The gas burner assembly of claim 1, wherein the plurality of apertures are defined proximate a bottom wall of the bottom housing and are a plurality of slots defined in a distal end of the center body.

16. The gas burner assembly of claim 1, wherein the bottom housing comprises a cylindrical sidewall, the boost fuel inlet and the boost air inlet each being positioned within or mounted to the cylindrical sidewall such that the boost fuel inlet directs the flow of fuel along the axial direction and the boost air inlet directs the flow of air in a plane perpendicular to the axial direction.

17. A cooktop appliance, comprising:

a top panel; and a gas burner assembly positioned on the top panel, the gas burner assembly comprising:

a bottom housing defining an axial direction, a radial direction, and a circumferential direction;

a center body positioned concentrically within the bottom housing to divide the bottom housing into a mixing chamber extending from the bottom housing to the center body along the radial direction and, an inner mixing chamber positioned inward of the center body and the mixing chamber along the radial direction, the center body further defining a plurality of apertures providing fluid communication between the mixing chamber and the inner mixing chamber;

an upper housing positioned over the center body and defining a boost burner chamber and a primary burner chamber, the boost burner chamber being in fluid communication with the inner mixing chamber of the center body;

a primary fuel inlet in fluid communication with the primary burner chamber; and a boost fuel inlet and a boost air inlet directly coupled to the bottom housing and being in in fluid communication with the mixing chamber, such that a flow of fuel and a flow of air mix in the mixing chamber before passing into the inner mixing chamber through the plurality of apertures.

18. The cooktop appliance of claim 17, wherein the boost fuel inlet injects the flow of fuel along a first direction and the boost air inlet injects the flow of air along a second direction, the second direction being perpendicular to the first direction.

19. The cooktop appliance of claim 17, wherein the boost fuel inlet and the boost air inlet are positioned proximate to each other on the bottom housing.

20. The cooktop appliance of claim 17, wherein the boost fuel inlet and the boost air inlet are positioned proximate a top of the mixing chamber and the plurality of apertures are defined at a bottom of the mixing chamber.

* * * * *